US005181400A

United States Patent [19]

Hodan

[11] Patent Number: 5,181,400

[45] Date of Patent: Jan. 26, 1993

[54] FINISH APPLICATOR

[75] Inventor: John A. Hodan, Arden, N.C.

[73] Assignee: BASF Corporation, Parsippany, N.J.

[21] Appl. No.: 646,105

[22] Filed: Jan. 25, 1991

[51] Int. Cl.[5] ..... D06B 1/08

[52] U.S. Cl. ..... 68/200; 118/420

[58] Field of Search ..... 68/200, 6; 28/178, 182; 118/266, 401, 411, 420, 423; 427/434.6, 434.7

[56] References Cited

U.S. PATENT DOCUMENTS

| | | | |
|---|---|---|---|
| 2,228,260 | 1/1941 | Dreyfus et al. | 28/178 X |
| 2,294,870 | 9/1942 | Kline et al. . | |
| 2,377,655 | 6/1945 | Stanley et al. . | |
| 2,868,159 | 1/1959 | Lit et al. | 118/420 X |
| 3,004,865 | 10/1961 | Schmitz . | |
| 3,162,544 | 12/1964 | Cobert | 68/200 X |
| 3,540,240 | 11/1970 | Higashino . | |
| 3,893,412 | 7/1975 | Louch et al. . | |
| 3,978,695 | 9/1976 | Hurzeler et al. . | |
| 4,051,807 | 10/1977 | Graf et al. . | |
| 4,338,876 | 7/1982 | Norton . | |
| 4,666,542 | 5/1987 | DeJonckheere | 118/420 X |
| 4,686,123 | 8/1987 | Leven . | |
| 4,704,311 | 11/1987 | Pickering et al. . | |
| 4,714,045 | 12/1987 | Reinehr et al. . | |
| 4,949,441 | 8/1990 | Ethridge . | |

FOREIGN PATENT DOCUMENTS

| | | | |
|---|---|---|---|
| 937729 | 9/1963 | United Kingdom | 68/6 |

*Primary Examiner*—Philip R. Coe

[57] ABSTRACT

A finish applicator includes one or more applicator plates stacked adjacent a guide plate and preferably between a pair of guide plates, at least one of the guide plates having an opening formed therein forming a yarn passageway and positioning the yarn in close proximity to, or in contact with an edge of the applicator plate. Alternatively, the guide plate and applicator plate may each have one or more openings formed therein which in registry form a yarn passageway when the plates are stacked. The opening in the guide plates may define retaining arms which maintain the yarn to be treated in close proximity to, or in contact with a treatment edge of each applicator plate.

10 Claims, 3 Drawing Sheets

FINISH APPLICATOR

BACKGROUND OF THE INVENTION

This invention relates to an apparatus for applying a finish or other treatment fluid to a yarn, filament or bundle of filaments.

Various types of applicators which employ nozzles or jets to apply a treatment fluid, such as a coating, dye or chemical treatment, to a fiber are known. (See, for example, U.S. Pat. No. 4,686,123 to Levan, U.S. Pat. No. 4,714,045 to Reinehr, et al., U.S. Pat. No. 3,978,695 to Hurzeler, et al., U.S. Pat. No. 3,004,865 to Schmitz and U.S. Pat. No. 2,377,655 to Stanley, et al.

Other known applicators employ rollers (See U.S. Pat. No. 4,704,311 to Pickering, et al.), spinning discs (See U.S. Pat. No. 4,338,876 to Norton) rotatable dishes (See U.S. Pat. No. 3,540,240 to Higashino) and reels (See U.S. Pat. No. 2,294,870 to Kline, et al.) to deliver coatings or treatments to a filament.

These previously known applicators are complicated, containing many components and thus many opportunities for malfunction. Additionally, due to their complexity, they are fairly expensive to produce and repairs to these applicators normally require fairly lengthy downtime.

The applicator described in U.S. Pat. No. 3,893,472 to Louch, et al. is one in which a traveling textile strand or yarn is aligned and guided into and through an open applicator channel which extends along the length of an elongated face of an elongated polyhedron. The applicator described in U.S. Pat. No. 4,051,807 to Graf, et al. includes an applicator head having a guide edge against which a filament bundle is passed and at which the filament bundle is exposed to the treatment. Disadvantages of this applicator include the fact that there is no means for maintaining the filament bundle against the guide edge, and that both sides of the filament bundle cannot be simultaneously treated.

SUMMARY OF THE INVENTION

It is an object of the invention to provide an apparatus for the application of a finish or other treatment fluid, such as a coating, dye or chemical treatment, to a yarn, filament or bundle of filaments.

It is also an object of the invention to provide an applicator which is simple, inexpensive and easy to manufacture.

It is a further object of the invention to provide an applicator which can easily be repaired or replaced.

It is a further object of the invention to provide an applicator which can simultaneously expose both sides of a filament or bundle of filaments to a treatment fluid.

These objectives and other advantages are achieved by the invention by providing an applicator comprising one or more applicator plates in a stacked arrangement adjacent to at least one guide plate. The yarn guide plate includes an opening, preferably in the form of a slot, to receive the yarn to be treated and to position the yarn for exposure to a treating fluid. The slot in the guide plate provides a passageway through which the yarn can pass so as to be positioned in close proximity to an edge of the applicator plate(s). When the opening is in the form of a slot, it defines one or more retaining arms which maintain the yarn against the treatment edge of the applicator plate. The applicator includes supply means for providing the finish fluid to an edge of the applicator plate. If necessary, channels are formed in the applicator plate to convey the finish fluid to the treatment edge of the applicator plate. Preferably, the channel widens to form a reservoir adjacent the treatment edge of the applicator plate. In preferred embodiments, the applicator plate also includes an opening which, when the applicator plate is stacked adjacent to the guide plate, aligns sufficiently with the opening in the guide plate to define the yarn passageway.

In other preferred embodiments, the applicator of the present invention treats both sides of the yarn simultaneously by including either: an applicator plate wherein finish fluid is provided to opposite sides of the opening in the applicator plate; or including at least two applicator plates, each having an edge to which treatment fluid is supplied so that the openings in the guide plates provide a passageway through which the yarn can pass so that opposite sides of the yarn each are positioned in close proximity to the treatment edge of an applicator plate.

The present invention will be described more fully hereinafter with reference to the accompanying drawings, in which illustrative embodiments of the invention are shown. This invention can, however, be embodied in many different forms and the invention should not be construed as being limited to the specific embodiments set forth herein. Rather, applicant provides these embodiments so that this disclosure will be thorough and complete and will fully convey the scope of the invention to those skilled in the art.

DETAILED DESCRIPTION OF THE PREFERRED EMBODIMENTS

While the invention will be described with reference to the treatment of yarn, it should be understood that the applicator of the invention can be used to treat, in single filaments or bundles of filaments, any type of yarn, string, or thread. Similarly, while the invention will be described in terms of a finish, it would be understood that the applicator of the invention can be used to treat yarn with a wide variety of treatment fluids, such as, for example, coatings of various types, dyes, and chemical treatments in the form of gases or liquids.

Figure 1A:
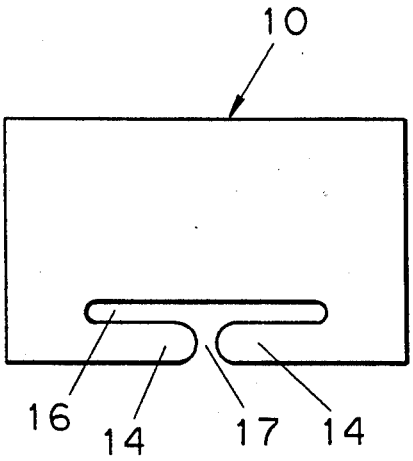
FIGS. 1A and 1B are plan views of a guide plate and applicator plate, respectively of one embodiment of the invention.

Referring now to the drawings, FIG. 1A illustrates a guide plate 10 suitable for use in the invention having an opening 16 in the form of an elongate slot. Slot 16 communicates with an edge of guide plate 10 via opening 17, thereby forming arms 14. The guide plates are preferably made from materials which offer a minimum amount of friction against the yarn or filaments so as to reduce the possibility of filament fraying. Suitable materials will protect the guide plates from abrasion by the running yarn and include, but are not limited to polished chrome platings and ceramics, with ceramics being preferred. The applicator of the invention will preferably include two guide plates 10 of the type shown in FIG. 1A with one or more applicator plates positioned therebetween.

Figure 1B:
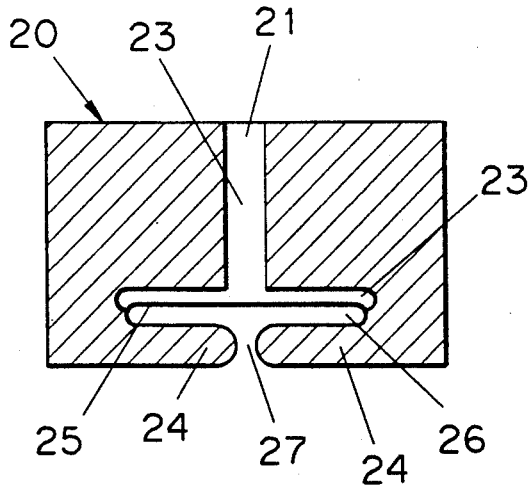

As seen in FIG. 1B, applicator plate 20 includes an elongated opening 26 in the form of a slot. Opening 26 defines arm portions 24 in applicator plate 20. Treatment fluid is provided to inlet 21 and is conveyed to edge 25 of slot 26 via channels 23. The applicator plate need not include an opening, but rather may simply be bound on one side, in part or whole, by a treatment edge to which treatment fluid is supplied.

In use, a pair of guide plates 10 and applicator plate 20 are preferably stacked such that guide plates 10 sandwich applicator plate 20 and a passageway is formed by openings 16 and 26 through which the yarn to be treated can pass. The applicator of the invention may include only a single guide plate by stacking one or more applicator plates above the guide plate. Arms 14 on guide block 10 maintain the yarn being treated in close proximity to edge 25 of applicator plate 10, and, therefore, in contact with the finish supply. By the term "close proximity" it is meant that the yarn will be sufficiently close to the treatment edge 25 of the applicator plate 20 that the yarn will be exposed to and contact the finish which is provided to treatment edge 25 of slot 26. In alternate embodiments the yarn will contact edge 25 of slot 26.

Guide plate 10 and applicator plate 20 may advantageously include openings 17 and 27, respectively which communicate slot 16 and 26 with an edge of the plates 10, 20, to facilitate the positioning of the yarn to be treated within the passageway formed by slots 16, 26. If the plates 10, 20 of the applicator of the invention do not include openings 17, 27, the yarn to be treated is simply threaded through the applicator.

Figure 2:
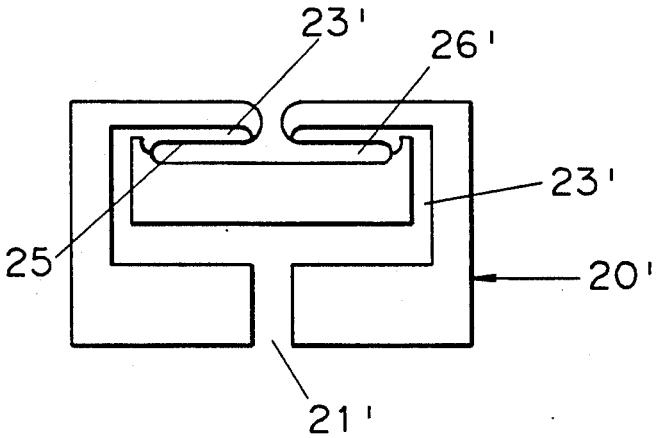
FIG. 2 is a plan view of an applicator plate of another embodiment of the invention.

Both sides of the yarn can be treated simultaneously by the applicator of the present invention by including two applicator plates, one of the type shown in FIG. 1B and another of the type shown in FIG. 2, between a pair of guide plates. As seen in FIG. 2, applicator plate 20' includes an opening 26' in the form of a slot. Treatment fluid is provided to inlet 21' and is conveyed to edge 25' of slot 26' via channels 23'. When applicator plates 20 and 20' are placed between a pair of guide blocks 10, a passageway is formed by openings 16, 26 and 26' through which the yarn can pass. Once positioned in the passageway, one side of the yarn will be positioned in close proximity to edge 25 of plate 20 and the other side of the yarn will be positioned in close proximity to edge 25' of plate 20', thereby applying a finish to both sides of the yarn simultaneously.

Figure 3:
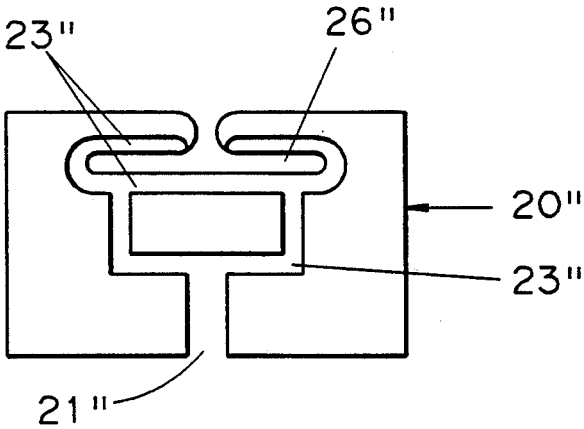
FIG. 3 is a plan view of an applicator plate of another embodiment of the invention.

Simultaneous application to both sides of a yarn can also be achieved by placing a plate of the type shown in FIG. 3 between a pair of guide blocks 10. Applicator plate 20'' includes and opening 26'' in the form of a slot. Channels 23'' convey treatment fluid provided to inlet 21'' to all edges of opening 26''. Thus, when the yarn passes through the passageway formed by openings 16 and 26'', all sides of the yarn are simultaneously exposed to the treatment fluid.

The applicator plates can be manufactured from any suitable material, such as, for example, mild steel, stainless steel, brass, aluminum or plastic. The applicator plate and the various features thereon can be formed by any suitable manufacturing technique such as, for example, die cutting, drilling, stamping, punching, etching, machining or molding or combinations thereof.

The overall dimensions of the yarn guide plate(s) and the applicator plate(s) may vary considerably. In general, the guide plates and the applicator plates may have the same or substantially the same planar dimensions. The length of the components will vary with the number of filaments to be treated and the number of corresponding openings or yarn slots which are necessary. As a rule of thumb, the components should have from about 0.26 to about 4.0 inches per opening or yarn slot.

The dimension of the treatment edge of each applicator plate may vary considerably, but is preferably sized for optimum coating of the yarn. For treating a bundle of filaments, the applicator preferably spreads the bundle into a ribbon of only a single filament in thickness so that each filament has equal access to the finish. In such a case the minimum suitable length of the treatment edge can be determined by multiplying the width of a single filament by the number of filaments in the bundle.

The thickness of the guide plates and the applicator plate may vary considerably and may be the same or different. Preferably, however, the thickness of the two guide plates are the same and may range from about 1/16 to about 0.25 inches. Compared to the guide plates, the thickness of the applicator plates is preferably relatively small, ranging from about 0.015 to about 0.10 inches. The depth of the channels formed in the applicator plates will vary according to the thickness of the applicator plate, but as a general rule the depth of thickness will represent from about 20% to about 100% of the thickness of the applicator plate 20.

The width of the various openings or slots may be the same or different, provided that openings in the applicator plates are at least as wide as the openings in the guide plates. The width of the openings or slots can vary depending upon the denier of the filament or yarn being treated, but preferably may range from about 0.04 to about 0.25 inches or more.

Figure 4:
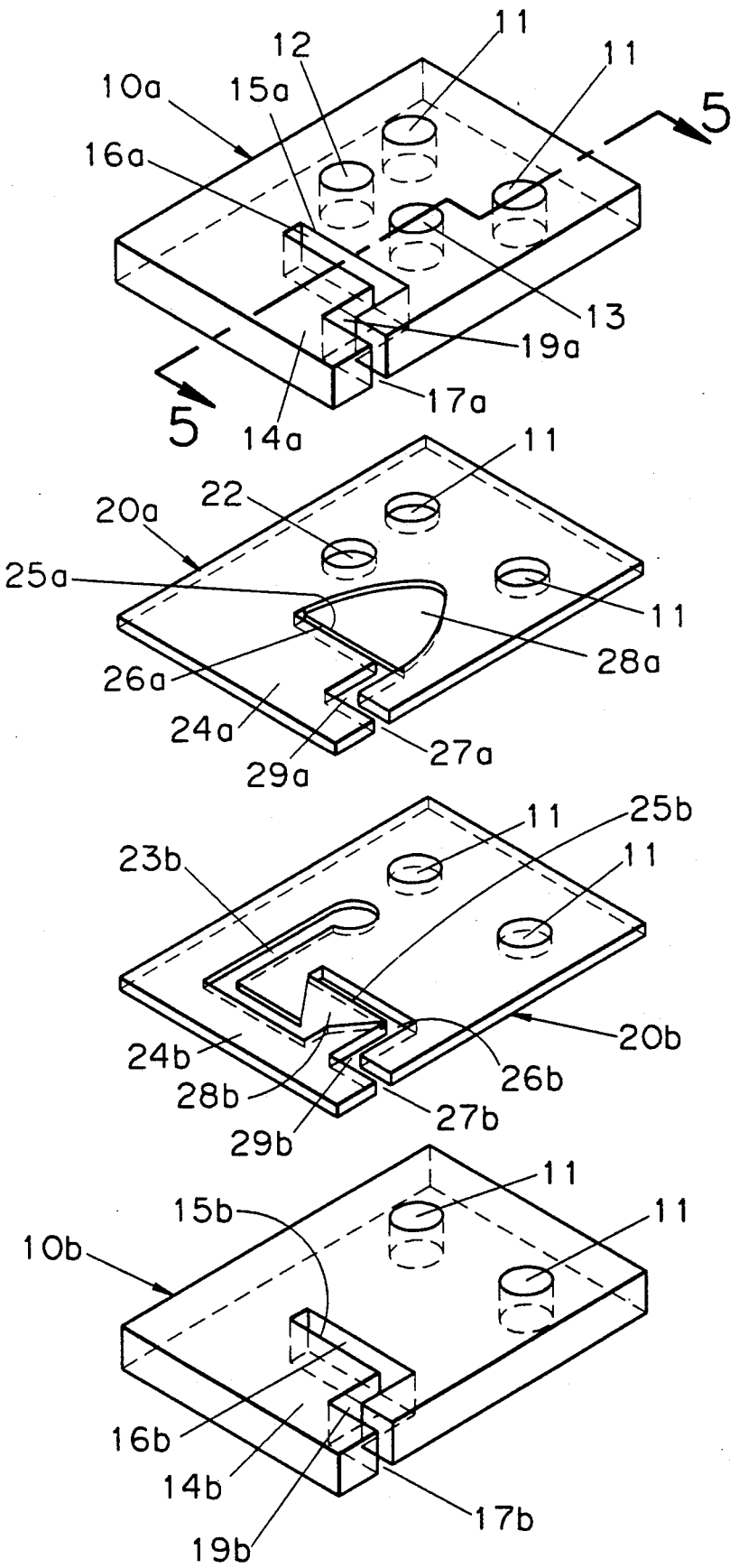
FIG. 4 is an exploded perspective view of another embodiment of the applicator of the invention.
Figure 5:
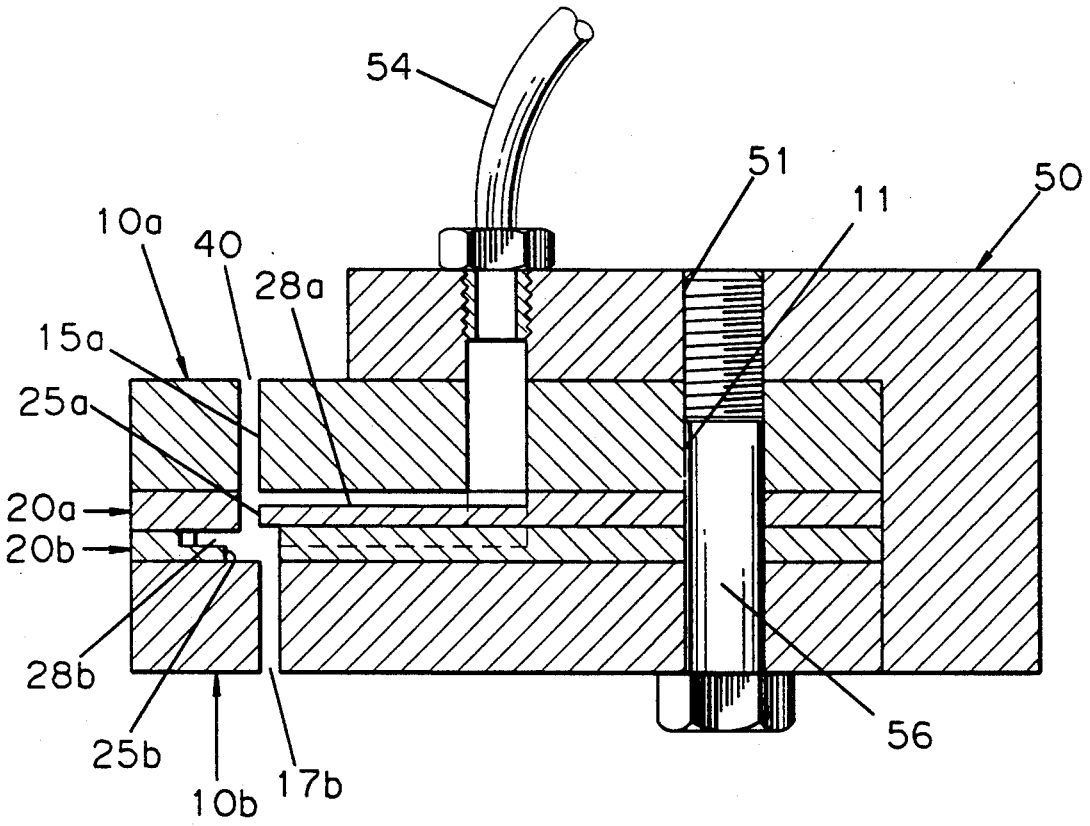
FIG. 5 is a cross-sectional view of the embodiment shown in FIG. 4 taken along line 5—5.

Operation of the applicator of the present invention will be described with reference to the embodiment thereof illustrated in FIGS. 4 and 5, wherein guide plates **10*a* and 10*b* are positioned on either side of applicator plates 20*a* and 20*b*. Any suitable means may be employed to align the components in precise registry with each other to maintain the components of the applicator in a tight fitting relationship. For example, apertures 11 may be formed in each component which, in the assembled applicator, provide throughways accommodating terminally threaded aligning bolt 56 which is received by threaded bore 51 in mounting block 50** to hold the components of the applicator together. Optionally, adjustment means (not shown) may be included for changing the alignment of the plates and thus fine-tuning the exact configuration of the yarn passageway formed by the openings in the guide plate(s) and/or the applicator plate(s).

Openings **16*a*, 16*b* in the form of slots define arm portions 14*a*, 14*b* in guide plates 10*a*, 10*b*. Guide plate 10*a* includes supply means in the form of inlet ports 12, 13 through which the finish or treatment fluid can be provided to applicator plates 20*b*, 20*a***, respectively.

Applicator plates **20*a*, 20*b* include openings 26*a*, 26*b* in the form of slots which define arm portions 24*a*, 24*b* of plates 20*a*, 20*b*. A reservoir 28*a* is formed in plate 20*a* adjacent to edge 25*a* of slot 26*a*. Finish or treatment fluid provided to inlet port 13 in guide plate 10*a* fills reservoir 28*a* and provides the finish to treatment edge 25*a* at which the finish will be applied to one side of the yarn. A reservoir 28*b* is formed in plate 20*b* adjacent to edge 25b of slot 26b. Finish or treatment fluid provided to inlet port 12 in guide plate 10a will pass through opening 22 in applicator plate 20a and be conveyed by channel 23b to reservoir 28b. Reservoir 28b provides the finish to treatment edge 25b** at which the finish will be applied to the other side of the yarn.

When the applicator is assembled, openings 16a, 16b, 26a and 26b form a yarn passageway 40. The yarn to be treated is placed into the applicator by passing through the portion of yarn passageway 40 defined by openings 17a, 27a, 27b and 17b at the edge of plates 10a, 20a, 20b and 10b, respectively. While arm portions 14a, 14b of guide plates 10a, 10b maintain the yarn in close proximity to treatment edges 25a, 25b of plates 20a, 20b, openings 16a, 16b may advantageously be formed with an angular offset 19a, 19b to prevent the yarn from moving laterally out of the yarn passageway 40. Slots 26a, 26b in applicator plates 20a, 20b should, of course, include corresponding angular offsets 29a, 29b to maintain the continuity of yarn passageway 40.

In operation, the yarn to be treated is continuously passed through yarn passageway 40. The yarn travels along edge 15a of guide plate 10a and is thus positioned in close proximity to edge 25a of plate 20a. Finish fluid supplied via supply tube 54, flows through inlet port 13 in guide plate 10a into reservoir 28a and from reservoir 28a flows over edge 25a so that one side of the yarn is exposed thereto. Similarly, finish fluid supplied to inlet port 12 flows into channel 23b to reservoir 28b and from reservoir 28b flows over edge 25b so that the other side of the yarn is exposed to the finish. The yarn travels against edge 15b of guide plate 10b and is thus maintained in close proximity to edge 25b of plate 20b. Thus, as yarn continuously passes along edges 25a, 25b an amount of the finish fluid which is applied to the yarn is continuously removed form reservoirs 28a, 28b. Thus, by continuously supplying finish to inlets 12 and 13 at a rate equal to the rate of consumption, a continuous supply of finish will be maintained in reservoirs 28a, 28b.

If the finish to be applied is a liquid, a metering pump may be used to regulate the flow of treatment fluid into the applicator. Alternatively, the finish can be fed simply by means of the hydraulic pressure in the feed line, requiring only that the supply tank holding the finish be located at a suitable height with respect to the applicator. The flow rate might typically range between 0.1 to 5.0 cc/min depending upon process speed, filament denier and number of filaments, and the amount of treatment fluid to be applied. In the finish is a gas, the rate of flow of the gaseous fluid into the applicator should match consumption (including any dispersion of the fluid which may occur).

It should be understood that by providing a stack of applicator plates, perhaps alternating with yarn guide plates, that repetitive treatments with the same finish or a series of sequential treatments with different treatment fluids can be achieved.

The foregoing description is to be considered illustrative rather than restrictive of the invention, and those modifications which come within the meaning and range of equivalence of the claims are to be included therein.

What is claimed is:

1. An apparatus for applying treatment fluid to yarn comprising:

at least one guide plate having an elongate opening formed therein;

at least one applicator plate stacked sealingly adjacent said guide plate, said opening in said guide plate forming a passageway through which multifilamentary yarn can pass and positioning the multifilamentary yarn in close proximity to an elongated fluid applicating edge of said applicator plate; said opening and said edge defining means to spread the multifilamentary yarn and apply fluid approximately evenly to the spread yarn; and supply means for providing treatment fluid to said edge of said applicator plate.

2. An apparatus as in claim 1 further comprising a reservoir formed in said applicator plate adjacent said edge of said applicator plate.

3. An apparatus as in claim 1 wherein said supply means comprises at least one inlet port in at least one guide plate and a channel formed in said applicator plate communicating said at least one inlet port with said edge of said applicator plate.

4. An apparatus for applying treatment fluid to yarn comprising:

at least one guide plate having an elongate opening formed therein;

at least one applicator plate stacked sealingly adjacent said guide plate and having an opening formed therein, said openings in said guide plate and said applicator plate communicating to form a passageway through which multifilamentary yarn can pass so as to be spread along an elongate fluid treatment edge of said opening in said applicator plate to cause each filament to receive approximately even fluid application; and supply means for providing treatment fluid to said edge of said opening in said applicator plate.

5. An apparatus as in claim 4 further comprising a reservoir formed in said applicator plate adjacent said edge of said opening in said applicator plate.

6. An apparatus as in claim 4 wherein said supply means comprises at least one inlet port in said at least one guide plate and a channel formed in said applicator plate communicating said at least one inlet port with said edge of said opening in said applicator plate.

7. An apparatus as in claim 4 wherein said supply means provides treatment fluid to more than one edge of said opening in said applicator plate.

8. An apparatus as in claim 4 wherein said openings in said guide plate and said applicator plate are formed as elongated slots.

9. An apparatus as in claim 8 wherein said end of said elongated slots in said guide plate and said applicator plate communicate with an edge of said guide plate and said applicator plate thereby forming an arm portion in said guide plate and said applicator plate.

10. An apparatus for applying treatment fluid to yarn comprising:

at least one guide plate having an elongate opening formed therein;

at least one applicator plate stacked adjacent said guide plate, said opening in said guide plate forming a passageway through which multifilamentary yarn can pass to an elongated fluid treatment edge of said applicator plate thereby defining means for spreading and guide multifilamentary yarn to said elongate edge where each filament receives approximately even fluid application; and supply means for providing treatment fluid to said edge of said applicator plate.

* * * * *